United States Patent [19]

Angevine

[11] 4,415,436

[45] Nov. 15, 1983

[54] PROCESS FOR INCREASING THE CETANE INDEX OF DISTILLATE OBTAINED FROM THE HYDROPROCESSING OF RESIDUA

[75] Inventor: Philip J. Angevine, West Deptford, N.J.

[73] Assignee: Mobil Oil Corporation, New York, N.Y.

[21] Appl. No.: 396,976

[22] Filed: Jul. 9, 1982

[51] Int. Cl.[3] ..... C10G 11/05; C10G 65/12

[52] U.S. Cl. ..... 208/89; 208/15; 208/157; 208/216 PP; 208/251 H

[58] Field of Search ..... 208/15, 89, 111, 216 PP, 208/157, 251 H

[56] References Cited

U.S. PATENT DOCUMENTS

| | | | |
|---|---|---|---|
| 3,876,523 | 4/1975 | Rosinski et al. | 208/89 |
| 3,882,049 | 5/1975 | Bertolacini et al. | 208/89 X |
| 4,054,508 | 10/1977 | Milstein et al. | 208/89 |
| 4,183,801 | 1/1980 | Breuker et al. | 208/59 |
| 4,197,184 | 4/1980 | Munro et al. | 208/89 |
| 4,344,840 | 8/1982 | Kunesh | 208/59 |

*Primary Examiner*—Curtis R. Davis

*Assistant Examiner*—George E. Schmitkons

*Attorney, Agent, or Firm*—Alexander J. McKillop; Michael G. Gilman; Charles J. Speciale

[57] ABSTRACT

A metal- and/or sulfur contaminated charge stock containing residua is hydrotreated in a first reaction zone in the presence of a hydrotreating catalyst comprising a hydrogenating component selected from the Group VIB and Group VIII metals, preferably a combination of nickel and molybdenum, on a refractory support, preferably alumina or silica-alumina, to reduce the metal and/or sulfur content thereof, the demetalated and/or desulfurized residua is hydrocracked in a second reaction zone in the presence of a hydrocracking catalyst comprising a nickel and tungsten impregnated rare earth exchanged zeolite X in combination with a nickel and tungsten impregnated silica-alumina matrix to provide distillate of higher cetane index than that achieved with hydrotreatment alone, and the liquid effluent from said second reaction zone is thereafter passed to a third reaction zone containing a hydrotreating catalyst which is the same as, or is different from, the hydrotreating catalyst in the first reaction zone to effect further hydrotreatment.

19 Claims, No Drawings

PROCESS FOR INCREASING THE CETANE INDEX OF DISTILLATE OBTAINED FROM THE HYDROPROCESSING OF RESIDUA

BACKGROUND OF THE INVENTION

This invention relates to a catalytic process for the sequential hydrotreating (demetalation and/or desulfurization) and mild hydrocracking of residua to provide distillate, i.e., a liquid product containing a major proportion by weight of components boiling at or below 650° F.

The term "residuum" refers to a complex hydrocarbon mixture containing a large fraction boiling at or above 650° F. Residua may be derived from petroleum, shale oil, tar sands or oil sands bitumen, diatomite bitumen, and coal liquids.

Motor fuel, diesel fuel and jet fuel are for the most part the most valuable products obtained from petroleum. Consequently the petroleum industry is geared to produce maximum amounts of these products. To this end, crude petroleum is distilled to obtain these desired fractions and that portion of the distillate boiling above the desired fractions is subjected to hydrocracking or to catalytic cracking to convert it to lower boiling material. However, residual petroleum oil fractions are characterized by relatively high metals and sulfur content. This comes about because practically all of the metals present in the original crude remain in the residual fraction, and a disproportionate amount of sulfur in the original crude oil also remains in that fraction. Principal metal contaminants are nickel and vanadium, with iron and small amounts of copper also sometimes present. Additionally, trace amounts of zinc and sodium are found in some feedstocks. The high metals content of the residual fractions generally precludes their effective use as charge stocks for subsequent catalytic processing such as catalytic cracking and hydrocracking. This is so because the metal contaminants deposit on the special catalysts for these processes and cause the formation of inordinate amounts of coke, dry gas and hydrogen. Also, the metals can irreversibly poison catalysts by blocking active sites.

It is current practice to upgrade certain residual fractions by a pyrolytic operation known as coking. In this operation the residuum is destructively distilled to produce distillates of low metals content and leave behind a solid coke fraction which contains most of the metals. Coking is typically carried out in a reactor or drum operated at about 800° to 1100° F. temperature and a pressure of one to ten atmospheres. The economic value of the coke by-product is determined by its quality, especially its sulfur and metals content. Excessively high levels of these contaminants limit the coke's use to low-valued fuel. In contrast, cokes of low metals content, for example up to about 100 ppm (parts-per-million by weight) of nickel and vanadium, and containing less than about 2 weight percent sulfur may be used in high valued metallurgical, electrical, and mechanical applications.

Certain residual fractions are currently subjected to visbreaking, which is a heat treatment of milder conditions than that used in coking, in order to reduce their viscosity and make them more suitable as fuels. Again, excessive sulfur content sometimes limits the value of the product.

Residual fractions are sometimes used directly as fuels. For this use, a high sulfur content in many cases is unacceptable for environmental reasons.

A number of catalytic processes for effecting the demetalation and/or desulfurization of residua are known.

U.S. Pat. No. 3,730,879 discloses a two-bed catalytic process for the hydrodesulfurization of crude oil or a reduced fraction in which at least 50 percent of the total pore volume of the first-bed catalyst consists of pores in the 100–200 Angstrom (A) average diameter range.

U.S. Pat. No. 3,830,720 discloses a two-bed catalytic process for hydrocracking and hydrodesulfurization of residual oils in which a small pore catalyst is disposed upstream of a large-pore catalyst.

U.S. Pat. Nos. 3,696,027 and 4,054,508 each describes a three-bed catalytic hydrotreating process.

U.S. Pat. Nos. 3,876,523 and 4,082,695 each describes a process for catalyticaly demetalizing and desulfurizing hydrocarbon oils comprising residual fractions utilizing a catalyst comprising a hydrogenation component, such as cobalt and molybdenum oxides, composited on a refractory base such as alumina.

SUMMARY OF THE INVENTION

In accordance with the present invention, a process is provided for increasing the cetane index of distillate obtained from the hydroprocessing of hydrocarbon residua which comprises passing a mixture of hydrogen and a metal-and/or sulfur- contaminated charge stock containing residua at a hydrogen partial pressure of from about 1,000 to about 3,000 psi, a temperature of from about 650° F. to about 875° F. and a space velocity of from about 0.1 to about 2.0 LHSV through trickle beds of catalyst disposed in three sequential reaction zones, said first reaction zone containing a bed of at least one hydrotreating catalyst comprising a hydrogenating component selected from the group consisting of Group VIB and Group VIII metals and combinations thereof on a refractory support, said second reaction zone containing a bed of hydrocracking catalyst comprising a nickel-tungsten impregnated rare earth exchanged zeolite X component in combination with a nickel-tungsten impregnated silica-alumina matrix, and said third reaction zone containing a bed of at least one hydrotreating catalyst, the same or different from the hydrotreating catalyst in said first zone, comprising a hydrogenating component selected from the group consisting of Group VIB and Group VIII metals and combinations thereof on a refractory support, thereby providing a distillate having a cetane index of at least about 50.

Conventional hydrotreatment of residua typically provides a distillate having a relatively low cetane index, e.g. 40 to 45. Employing the process of this invention, it is now possible to provide an upgraded distillate product having a cetane index of at least about 50 and preferably a cetane index of at least about 60.

The term "distillate" as employed herein shall be understood to define a liquid hydrocarbon product whose principal fractions have boiling points below about 650° F.

DESCRIPTION OF THE PREFERRED EMBODIMENTS

In accordance with this invention, a hydrocarbon charge stock, preferably one containing a substantial quantity of residual fractions, is hydrotreated to remove both metals and sulfur therefrom and thereafter hydrocracked to provide lighter products, in particular, distillate, in three distinct sequential reaction zones, the first and third of which contain one or more hydrotreating catalysts of a type hereinafter defined and the second of which contains a hydrocracking catalyst of a type hereinafter defined.

The charge stock for the process of this invention can be any metals-contaminated hydrocarbon in which a substantial portion boils at above 650° F. A process in accordance with the previously described operating conditions is especially advantageous in connection with charge stocks having a "metals factor" of greater than about 25, said metals factor, or $F_m$, being equal to the summation of the metals concentration in parts per million of iron and vanadium plus ten times the amount of nickel and copper in parts per million which may be expressed in equation form as follows:

$$F_m = Fe + V + 10\ (Ni + Cu)$$

Additional metals pose problems for processing shale oil, notably arsenic, selenium and lead. The metals indigenous to petroleum crudes are also found in bitumens, but often in greater quantities. Coal-derived liquids may contain titanium, arsenic, silica and alumina - some associated with trace amounts of ash.

From what has been said, it will be clear that the charge stock can be a whole crude. However, since the high metal and sulfur components of a crude oil tend to be concentrated in the higher boiling fractions, the present process more commonly will be applied to a bottoms fraction of a petroleum oil, i.e., one which is obtained by atmospheric distillation of a crude petroleum oil to remove lower boiling materials such as a naphtha and furnace oil, or by vacuum distillation of an atmospheric residue to remove gas oil. Typical residues to which the present invention is applicable will normally be substantially composed of residual hydrocarbons boiling above 900° F. and containing a substantial quantity of asphaltic materials. Thus, the chargestock can be one having an initial or 5 percent boiling point somewhat below 900° F., provided that a substantial proportion, for example, about 20 to 30 percent by volume, of its hydrocarbon components boil above 900° F. A hydrocarbon stock having a 50 percent boiling point of about 900° F. and which contains asphaltic materials, 4% by weight sulfur and 51 ppm nickel and vanadium is illustrative of such charge stock.

The hydrogen gas which is used during the hydrodemetalation/hydrodesulfurization is circulated at a rate between about 1,000 and 15,000 s.c.f./bbl. of feed and preferably between about 3,000 and 8,000 s.c.f./bbl. The hydrogen purity may vary from about 60 to 100 percent. If the hydrogen is recycled, which is customary, it is desirable to provide for bleeding-off a portion of the recycle gas and to add makeup hydrogen in order to maintain the hydrogen purity within the specified range. Satisfactory removal of hydrogen sulfide from the recycled gas wil ordinarily be accomplished by such bleed-off procedures. However, if desired, the recycled gas can be washed with a chemical absorbent for hydrogen sulfide or otherwise treated in a known manner to reduce the hydrogen sulfide content thereof prior to recycling.

The charge stock and hydrogen are introduced to the reactor at a hydrogen partial pressure of from about 1,000 to about 3,000 psi, preferably from about 1,500 to about 2,500 psi, a temperature of from about 650° F. to about 875° F., preferably from about 700° F. to about 825° F., and a space velocity of from about 0.1 to about 2.0 LHSV, preferably from about 0.15 to about 0.75 LHSV.

The hydrotreating catalyst comprises a hydrogenating component selected from at least one member of the group consisting of Group VIB and Group VIII metals. Especially effective hydrotreating catalysts for the purposes of this invention are those comprising molybdenum and at least one member of the iron group metals. Preferred catalysts are those containing nickel and molybdenum (which is especially advantageous), and other combinations of iron group metals and molybdenum such as iron, zinc or cobalt and molybdenum. Particularly preferred compositions for the hydrotreating catalyst to be used in the process of this invention are those which contain on a weight basis a total metals content of from about 10 percent to about 30 percent, e.g., from about 2 percent to about 5 percent nickel or cobalt and from about 8 percent to about 25 percent molybdenum, the remainder consisting of porous and refractory support, preferably alumina or an alumina-silica mixture containing a minor proportion, e.g., about 10 weight percent, silica. These metals can be composited with the refractory support employing any of the known methods.

In a preferred embodiment of the present invention, a relatively large sized average pore diameter hydrotreating catalyst alone or superimposed upon a relatively intermediate sized average pore diameter hydrotreating catalyst is disposed within the first reaction zone and a relatively small sized average pore diameter hydrotreating catalyst is disposed within the third reaction zone. The three reaction zones can be arranged in a single reaction or any two of the zones can be arranged in one reactor, the other occupying a separate reactor connected to the first. Other multiple reactor configurations are also within the scope of this invention.

The large average pore diameter hydrotreating catalyst in the first reaction zone preferably varies from about 160 to about 200 A and the intermediate average pore diameter hydrotreating catalyst, when used, preferably varies from about 100 to about 10 A. The small average pore diameter hydrotreating catalyst in the third reaction zone preferably is within the range of from about 60 to about 95 A.

The hydrocracking catalyst which occupies the second reaction zone herein preferably comprises (1) nickel-tugnsten impregnated upon a rare earth exchanged zeolite X (Ni-W/REX) and (2) as a matrix material, a silica-alumina impregnated with nickel-tungsten (Ni-W/$SiO_2$-$Al_2O_3$). Such a catalyst and its preparation are described in U.S. Pat. No. 3,620,964, the disclosure of which is incorporated by reference herein. U.S. Pat. No. 3,210,267 which is incorporated by reference herein describes rare earth exchanged zeolite X and its manner of preparation. In the preferred catalyst, the total metals content by weight can range from about 10 to about 20 percent, e.g., from about 2 to about 5 weight percent nickel and from about 8 to about 15 weight percent tungsten, the remainder being the rare earth exchanged zeolite X and silica-alumina. The average pore diameter of the hydrocracking catalyst is preferably from about 50 to about 80 A.

The volumetric ratios of catalyst in the first, second and third reaction zones can vary widely. In a preferred embodiment of the invention, the volumetric ratio is about 6:1:3 and where large and intermediate average pore diameter hydrotreating catalysts are present in the first reaction zone, their volumetric ratio can advantageously be about 1:1. In general, the amount of catalyst in reaction zone 1 is proportional to the metals removal requirement.

EXAMPLE

By way of illustrating the advantages of the process herein over known hydroprocessing methods, a North Slope petroleum vacuum residuum was hydroprocessed employing a known hydrotreating technique and another portion of such residuum was hydroprocessed employing a combination of hydrotreating and hydrocracking catalysts in accordance with the invention. In the known method, the residuum was treated with hydrogen in the presence of hydrotreating catalysts A, B and C disposed in three reaction zones in a 25:35:40 volumetric ratio. In the process illustrative of this invention two hydrotreating catalysts of large and intermediate sized average pore diameter, catalysts A and D, were arranged in the upper and lower levels, respectively, of a first reaction zone, a hydrocracking catalyst E was disposed in a second reaction zone and hydrotreating catalyst C was disposed in the third reaction zone. The volumetric ratio of catalysts A, D, E and C was 30:30:10:30. The overall composition of each catalyst, the processing conditions and the results of the hydroprocessing runs are set forth below in Tables 1, 2 and 3.

TABLE 1

Properties of the Hydrotreating and Hydrocracking Catalyst

| | Hydrotreating Catalyst | | | | Hydro-Cracking |
|---|---|---|---|---|---|
| | A | C | B | D | Catalyst E |
| Component, Weight % | | | | | |
| Ni | 2.75 | 2.4 | 4.1 | 3.2 | 3.8 |
| $MoO_3$ | 10.0 | 14.6 | 20.7 | 19.0 | — |
| W | — | — | — | — | 10.1 |
| $SiO_2$ | — | 5.1 | 3.8 | — | 51.5 |
| $Al_2O_3$ | 86.5 | 77.2 | 70.2 | 76.9 | 20.3 |
| Surface Area, $m^2/g$ | 103 | 255 | 157 | 152 | 364 |
| Real Density, g/cc | 3.69 | 3.547 | 3.40 | 3.478 | 2.91 |
| Particle Density, g/cc | 1.28 | 1.258 | 1.42 | 1.383 | 1.10 |
| Pore Volume, cc/g | 0.511 | 0.513 | 0.410 | 0.436 | 0.565 |
| Average Pore Diameter, A | 198 | 80 | 120 | 115 | 62 |
| Pore Size Distribution, cc/g | | | | | |
| 0-30 A | .036 | .007 | — | .018 | .397 |
| 30-50 A | .010 | .065 | — | .023 | .021 |
| 50-80 A | .010 | .383 | — | .110 | .030 |
| 80-100 A | .015 | .032 | — | .114 | .039 |
| 100-150 A | .107 | .014 | — | .135 | .067 |
| 150-200 A | .256 | .001 | — | | .006 |
| 200-300 A | .046 | .002 | — | .010 | .000 |
| Above 300 A | .031 | .009 | — | .026 | .005 |

TABLE 2

Processing Conditions and Material Balance

| | Hydroprocessing with Hydrotreating Catalysts A, B and C | Hydroprocessing with Hydrotreating Catalysts A, D and C and Hydro-Cracking Catalyst E |
|---|---|---|
| Reactor Conditions | | |
| Temperature, °F. | 775 | 775 |
| Pressure, psig | 2200 | 2200 |
| LHSV | .2 | .2 |
| Days-on-stream | 8.3 | 7.2 |

TABLE 2-continued

Processing Conditions and Material Balance

| | | |
|---|---|---|
| H circulation, s.c.f./bbl. feed | 5371 | 9670 |
| Hydrocarbon Yields, weight % | | |
| $C_1$-$C_3$'s | 2.22 | 2.56 |
| $C_4$'s | 0.94 | 1.61 |
| $C_5$'s and above | 96.44 | 95.34 |
| 1,000° F. and above, volume % | 40.19 | 39.5 |
| H consumption s.c.f./bbl. feed | 1427 | 1272 |

TLP ($C_5$ and above) Properties

| | Charge | Product | Charge | Product |
|---|---|---|---|---|
| Gravity, °API | 9.3 | 24.3 | 9.3 | 24.5 |
| H, weight % | 10.69 | 12.47 | 10.95 | 12.42 |
| S, weight | 2.10 | 0.103 | 1.87 | 0.056 |
| N, weight | 0.45 | 0.14 | 0.54 | 0.15 |
| CCR, weight | 13.84 | 3.02 | 14.91 | 2.74 |
| V, ppm | 72 | 0.6 | 72 | 0.2 |
| Ni, ppm | 37 | 0.6 | 37 | 0.3 |
| MW | 739 | 417 | 739 | 398 |
| asphaltenes, weight % | 10.7 | 1.3 | 10.7 | 1.5 |
| Basic N, weight % | 0.15 | 0.03 | 0.15 | 0.03 |
| Paraffins, weight % | — | 11.8 | — | 12.6 |
| Naphthenes, weight % | — | 38.5 | — | 38.4 |
| Aromatics, weight % | — | 49.7 | — | 49.0 |

TABLE 3

Properties of Boiling Point Fractions

| | Hydroprocessing with Hydrotreating Catalysts A, B and C | Hydroprocessing with Hydrotreating Catalysts A, D and C and Hydrocracking Catalyst E |
|---|---|---|
| Yields, weight % liquid product | | |
| IBP-125° F. | 2.7 | 0 |
| 125-380° F. | 5.9 | 5.82 |
| 380-650° F. | 20.6 | 17.23 |
| 650° F. and above | 70.8 | 76.95 |
| 125-380° F. | | |
| Volume % liquid product | 6.7 | 7.14 |
| Gravity, °API | 46.2 | 59.9 |
| Bromine No. | 0.8 | 1.9 |
| Combined Aromatics and Olefins, % | | 16.2 |
| 380-650° F. | | |
| Volume %, liquid product | 21.2 | 19.4 |
| Gravity, °API | 29.0 | 44.1 |
| Bromine No. | 1.9 | 1.0 |
| Combined Aromatics and Olefins, % Mid-boiling point, °F. | 557 | 537 |
| Cetane Index | 43 | 72 |
| 650° F. and above | | |
| Volume %, liquid product | 68.8 | 73.5 |
| Gravity, °API | 20.0 | 17.4 |
| H, weight % | 12.25 | 12.04 |
| S, weight % | 0.07 | 0.07 |
| N, weight % | 0.21 | 0.18 |
| Ni, ppmw | 2.3 | 0.44 |
| V, ppmw | 2.0 | 0.10 |

As these data show, hydroprocessing residua employing a combination of hydrotreating and hydrocracking catalysts in accordance with this invention results in a substantial increase in cetane index of the resulting distillate compared with the cetane index of a distillate obtained by known hydroprocessing techniques which employ only hydrotreating catalyst.

What is claimed is:

1. A process for increasing the cetane index of distillate obtained from the hydroprocessing of petroleum residua which comprises passing a mixture of hydrogen and a metal- and/or sulfur-contaminated charge stock containing residua at a hydrogen partial pressure of from about 1,000 to about 3,000 psia a temperature of from about 650° F. to about 875° F. and a space velocity of from about 0.1 to about 2.0 LHSV through trickle beds of catalyst disposed in three sequential reaction zones, said first reaction zone containing a bed of at least one hydrotreating catalyst comprising a hydrogenating component selected from the group consisting of Group VIB and Group VIII metals and combinations thereof on a refractory support, said second reaction zone containing a bed of hydrocracking catalyst comprising a nickel-tungsten impregnated rare earth exchanged zeolite X component in combination with a nickel-tungsten impregnated silica-alumina matrix, and said third reaction zone containing a bed of at least one hydrotreating catalyst, the same or different from the hydrotreating catalyst in said first zone, comprising a hydrogenating component selected from the group consisting of Group VIB and Group VIII metals and combinations thereof on a refractory support thereby providing a distillate having a cetane index of at least about 50.

2. The process of claim 1 wherein said upgrading is carried out in ebullating catalyst bed reactors, in which at least three reactors are employed such that each catalyst employs a separate reactor and the processing maintains the same catalyst sequence.

3. The process of claim 1 wherein the charge stock is substantially composed of residual hydrocarbons boiling above about 900° F.

4. The process of claim 1 wherein the charge stock is introduced at a hydrogen partial pressure of from about 1,500 to about 2,500 psi, a temperature of from about 700° F. to about 825° F. and a space velocity of from about 0.15 to about 0.75 LHSV.

5. The process of claim 1 wherein said three sequential zones are contained in one reactor.

6. The process of claim 1 wherein the hydrotreating catalyst in the first and third reaction zones comprises nickel and molybdenum on a refractory support.

7. The process of claim 6 wherein said refractory support is alumina, silica, silica alumina, titania, zirconia, chronia, or combinations thereof.

8. The process of claim 6 wherein said refractory support is manganese modules, bog manganese, bog iron, ferrite, pyrite, arsenopyrite, niccolite, diatomaceous earth, quartz, or combinations thereof.

9. The process of claim 1 wherein there are at least two hydrotreating catalysts in said first reaction zone arranged in superimposed levels with the hydrotreating catalyst in the upper level possessing a relatively large sized average pore diameter and the hydrotreating catalyst in the lower level possessing a relatively imtermediate sized average pore diameter, it being further provided that the hydrotreating catalyst in the third reaction zone possesses a relatively small sized average pore diameter.

10. The process of claim 9 wherein the average pore diameter of the hydrocracking catalysts in the upper and lower levels of the first reaction zone are from about 160 to about 200 A and from about 100 to about 140 A, respectively, and the average pore diameter of the hydrocracking catalyst in the third reaction zone is from about 60 to about 95 A.

11. The process of claim 1 wherein the total metal content of the hydrotreating catalyst in the first and third reaction zones is from about 10 to about 30 weight percent of the catalyst.

12. The process of claim 6 wherein the nickel is present at a level of from about 2 to about 5 weight percent, and the molybdenum is present at a level of from about 8 to about 25 weight percent, of the catalyst.

13. The process of claim 1 wherein the total content of nickel and tungsten in the hydrocracking catalyst is from 10 to about 20 weight percent of the catalyst.

14. The process of claim 13 wherein the nickel is present at a level of from about 2 to about 5 weight percent, and the tungsten is present at a level of from about 8 to about 15 weight percent, of the catalyst.

15. The process of claim 1 wherein the cetane index of the product middle distillate is at least about 60.

16. The process of claim 1 wherein the cetane index of the product middle distillate is at least about 70.

17. The process of claim 1 wherein the volumetric ratio of the catalyst in the first, second and third reaction zones is about 6:1:3.

18. The process of claim 9 or 10 wherein the volumetric ratio of the hydrotreating catalyst in the upper level of the first reaction zone to the hydrotreating catalyst in the lower level of the first reaction zone is about 1:1.

19. The process of claim 18 wherein the volumetric ratio of the first, second and third reaction zones is about 6:1:3.

* * * * *

UNITED STATES PATENT AND TRADEMARK OFFICE

CERTIFICATE OF CORRECTION

PATENT NO. : 4,415,436

DATED : November 15, 1983

INVENTOR(S) : P.J. Angevine

It is certified that error appears in the above-identified patent and that said Letters Patent is hereby corrected as shown below:

Column 4, line 44 "10 A" should be --140 A--.

Signed and Sealed this

*Nineteenth* Day of *June 1984*

[SEAL]

*Attest:*

GERALD J. MOSSINGHOFF

*Attesting Officer*

*Commissioner of Patents and Trademarks*